US006702610B2

(12) United States Patent
Zheng et al.

(10) Patent No.: US 6,702,610 B2
(45) Date of Patent: Mar. 9, 2004

(54) MULTI-PORT MODULAR JACK ASSEMBLY WITH DETACHABLE INSERT SUBASSAMBLIES

(75) Inventors: Qisheng Zheng, Kunsan (CN); Zhenghua Xu, Kunsan (CN); JunXian Liu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 36 days.

(21) Appl. No.: 10/253,186

(22) Filed: Sep. 23, 2002

(65) Prior Publication Data

US 2004/0002258 A1 Jan. 1, 2004

(30) Foreign Application Priority Data

Jun. 28, 2002 (TW) ..... 91209763 U

(51) Int. Cl.[7] ..... H01R 13/60

(52) U.S. Cl. ..... 439/541.5; 439/676; 439/701; 439/490; 439/441

(58) Field of Search ..... 439/541.5, 676, 439/941, 607, 620, 701, 76.1, 490, 741, 638

(56) References Cited

U.S. PATENT DOCUMENTS

| | | | | |
|---|---|---|---|---|
| 4,790,769 | A | * | 12/1988 | Kanada |
| 5,531,612 | A | | 7/1996 | Goodall et al. |
| 5,562,507 | A | * | 10/1996 | Kan |
| 5,639,267 | A | | 6/1997 | Loudermilk |
| 6,019,631 | A | * | 2/2000 | Chen |
| 6,206,725 | B1 | | 3/2001 | Wu |
| 6,296,527 | B1 | * | 10/2001 | Zhang et al. |
| 6,537,110 | B1 | * | 3/2003 | Korsunsky et al. |

* cited by examiner

*Primary Examiner*—Dean A. Reichard
*Assistant Examiner*—Nguyen T. Ha
(74) *Attorney, Agent, or Firm*—Wei Te Chung

(57) ABSTRACT

A modular jack assembly (1) includes an outer case (2) and a plurality of insert subassemblies (3). The outer case defines a plurality of chambers (23) and a plurality of pairs of engaging channels (231) communicating with corresponding chambers. Each insert subassembly is received in a corresponding chamber and has a pair of resilient latch arms (422, 522) engaging with a corresponding pair of engaging channels for retaining the insert subassembly in the outer case. The latch arms can be elastically deformed to each other to disengaging from the engaging channels.

16 Claims, 6 Drawing Sheets

MULTI-PORT MODULAR JACK ASSEMBLY WITH DETACHABLE INSERT SUBASSAMBLIES

CROSS-REFERENCE TO RELATED APPLICATION

The present application is related to a contemporaneously filed U.S. patent application entitled to "ELECTRICAL CONNECTOR WITH INSERT-MOLDING STRUCTURE", and another application entitled to "ELECTRICAL CONNECTOR", invented by the same inventor, and assigned to the common assignee.

BACKGROUND OF THE INVENTION

1. Field of the Invention

The present invention relates to an electrical connector, and more particularly to a modular jack assembly having a plurality of detachable insert subassemblies.

2. Description of the Prior Art

In a Local Area Network (LAN) such as a small business company, a plurality of computers and servers are interconnected through an infrastructure. In order to provide a convenient access to the server, a router has been introduced in which a plurality of modular jacks, serving input and output ports, has been introduced. As a result, information as well as data can be freely and quickly communicated within the LAN.

In order to reduce the cost and space, a modular jack assembly, which integrates a plurality of modular jacks in a single housing, has been widely adopted in the art. U.S. Pat. No. 5,531,612 issued to Goodall et al on Jul. 2, 1996 discloses such a modular jack assembly. The Goodall modular jack assembly comprises a plurality of modular jacks assembled to a common integral housing and disposed in back-to-back mirror image symmetry.

U.S. Pat. No. 5,639,267 issued to Loudermilk on Jun. 17, 1997 also discloses a modular jack assembly. The Loudermilk modular jack assembly comprises an outer case defining a plurality of chambers and a plurality of insert subassemblies received in corresponding chambers. Each chamber forms a pair of hook portions. Each insert subassembly comprises a pair of locking wedges engaging with the hook portions of a corresponding chamber, thereby securely retaining the insert subassembly in the outer case. After the modular jack assembly is fabricated, it must be verified whether every insert subassembly thereof is capable of functioning properly. However, if an insert subassembly is test to be defective, the defective insert subassembly cannot be replaced from the outer case because of the retaining of the locking wedges, resulting in a bad quality of the Loudermilk modular jack assembly.

Hence, an improved modular jack assembly is desired to overcome the disadvantages of the prior art.

BRIEF SUMMARY OF THE INVENTION

A main object of the present invention is to provide a modular jack assembly having a plurality of detachable insert subassemblies.

A modular jack assembly in accordance with the present invention comprises an outer case and a plurality of insert subassemblies. The outer case defines a plurality of chambers. A pair of engaging channels are defined in opposite inner surfaces of each chamber. Each engaging channel has an engaging recess in a distal end thereof. Each insert subassembly is inserted into a corresponding chamber from a rear wall of the outer case and comprises a pair resilient latch arms engaging with the engaging channels of a corresponding chamber of the outer case, thereby retaining the insert subassembly in the outer case. Each latch arm forms an engaging protrusion for engaging with an engaging recess of a corresponding chamber for securely retaining the insert subassembly in the outer case.

Pulling rearwardly a defective insert subassembly, the resilient latch arms of the defective insert subassembly are forced to be elastically deform to each other. As a same time, the engaging protrusions of the resilient latch arms disengage from the engaging recesses of the outer case. As a result, the defective insert subassembly is pulled out from the outer case. The modular jack assembly can be renewed by inserting a properly functioning insert subassembly.

Other objects, advantages and novel features of the invention will become more apparent from the following detailed description when taken in conjunction with the accompanying drawings.

DETAILED DESCRIPTION OF THE INVENTION

Figure 1:
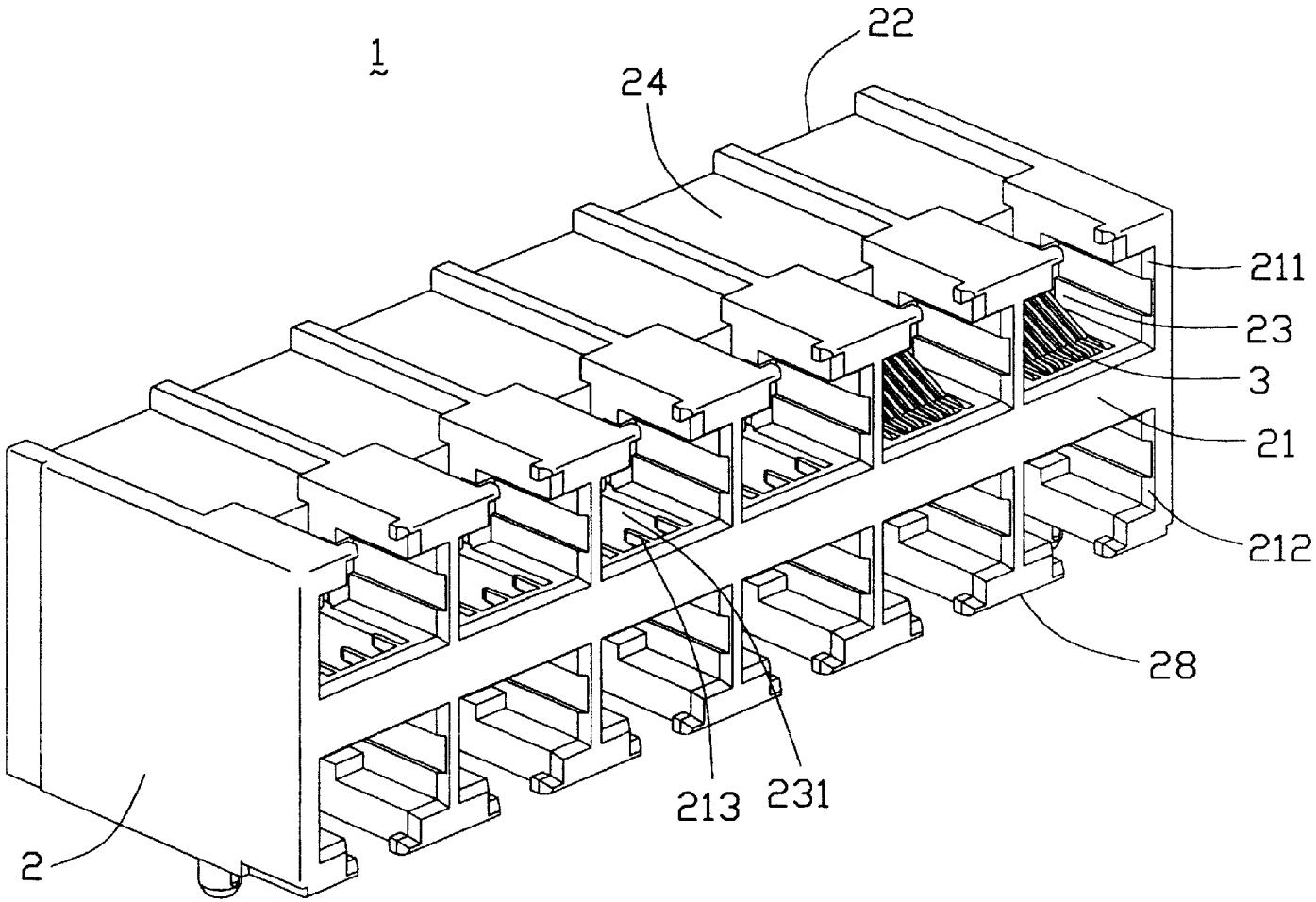
FIG. 1 is a perspective view of a modular jack assembly according to the present invention, with some insert subassemblies of the modular jack assembly removed for clarity.

Referring to FIGS. 1–4, a modular jack assembly 1 according to the present invention comprises an insulative outer case 2, a plurality of insert subassemblies 3 received in the outer case 2.

The outer case 2 defines a plurality of mating openings 211, 212 in a front wall 21 arranged in an upper row and a lower row. The upper row of the mating openings 211 is a mirror image of the lower row of the mating openings 212. The outer case 2 defines a plurality of chambers 23 extending from the front wall 21 to a rear wall 22 of the outer case 2. Each chamber 23 communicates with outside though the rear wall 22 and communicates with a corresponding pair of upper and lower mating openings 211, 212.

A plurality of pairs of upper and lower retaining members 26, 27 respectively and uprightly project from a top wall 24 and a bottom wall 28 of the outer case 2 into corresponding chambers 23 and are parallel to the front wall 21. Each retaining member 26 or 27 uprightly defines a plurality of parallel retaining slits 261 or 271 therethrough. A pair of elongate engaging channels 231 are defined in middle portions of opposite inner surfaces of each chamber 23 for engaging with corresponding insert subassembly 3. Each engaging channel 231 extends in a front-to-rear direction and comprises a communicating engaging recess 232 on a front end thereof. Two rows of ribs 213 are formed on an inner surface of the front wall 21 between the upper and the lower mating opening 211, 212 and project rearwardly into a corresponding chamber 23 for retaining a corresponding insert subassembly 3.

Figure 2:
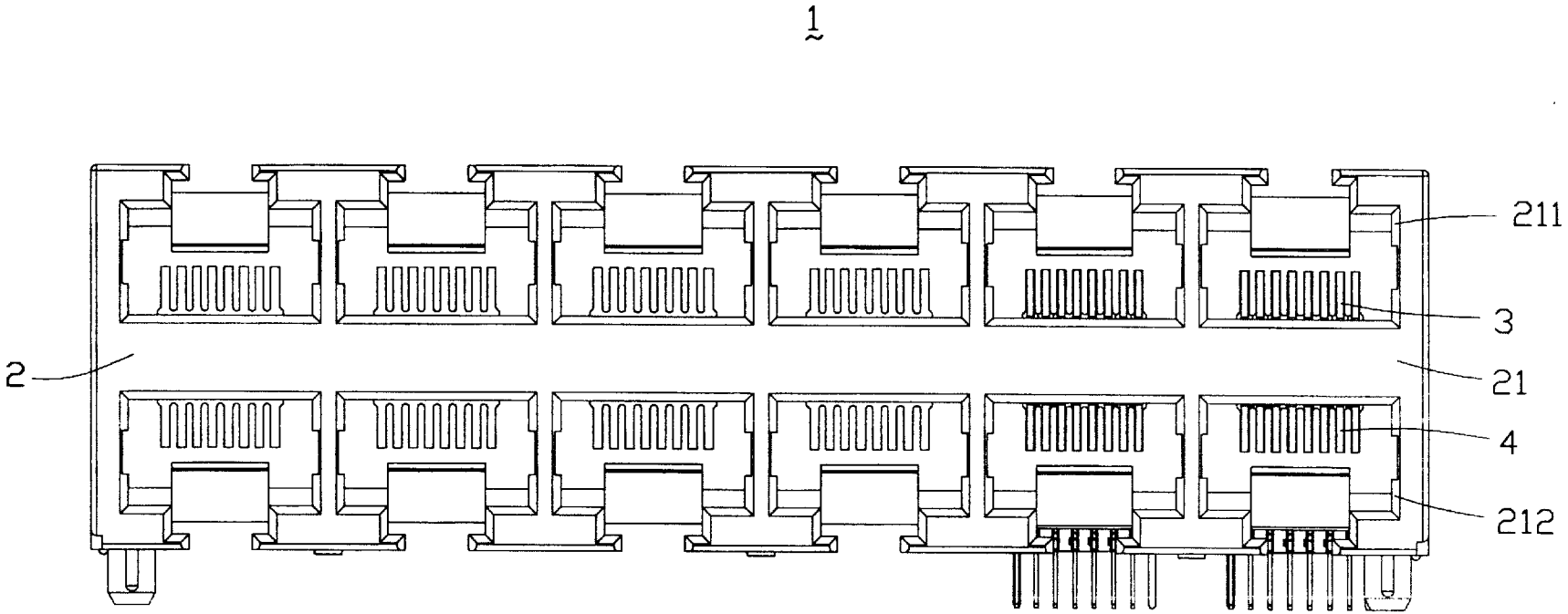
FIG. 2 is a front view of FIG. 1.
Figure 3:
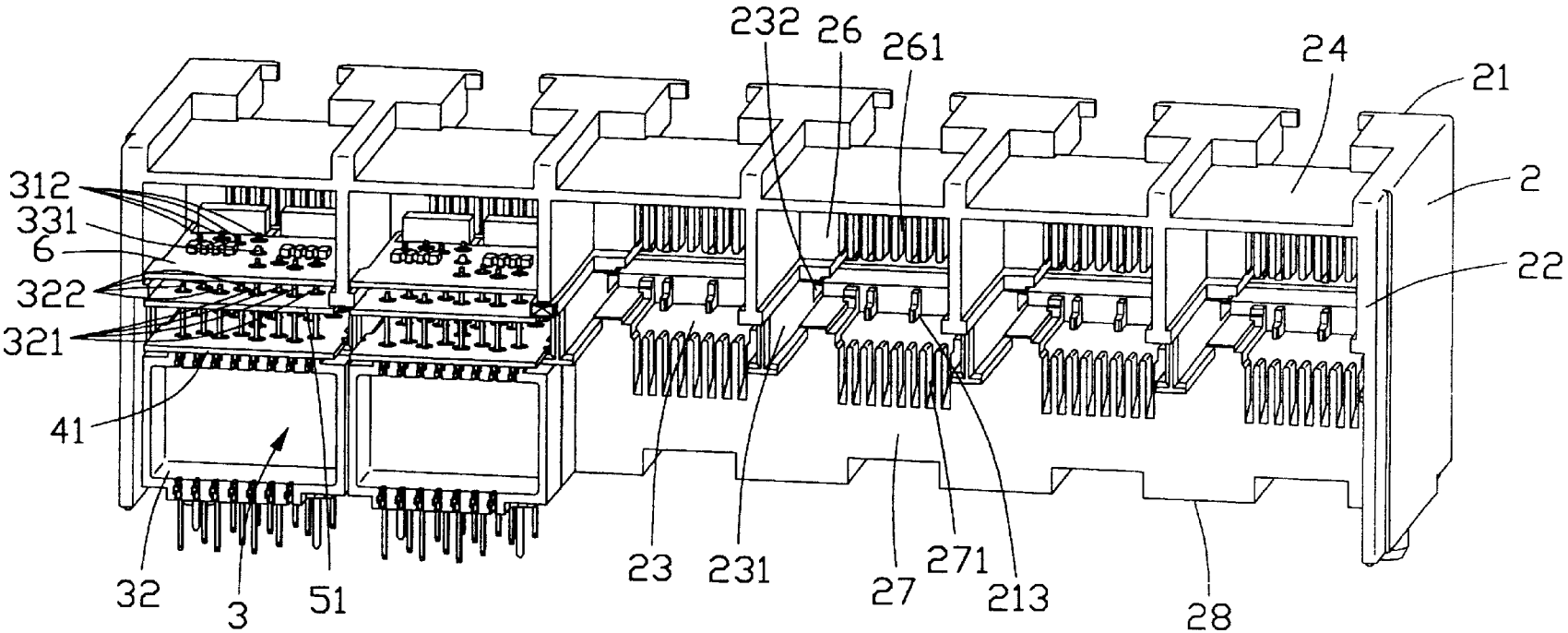
FIG. 3 is another perspective view of FIG. 1.
Figure 4:
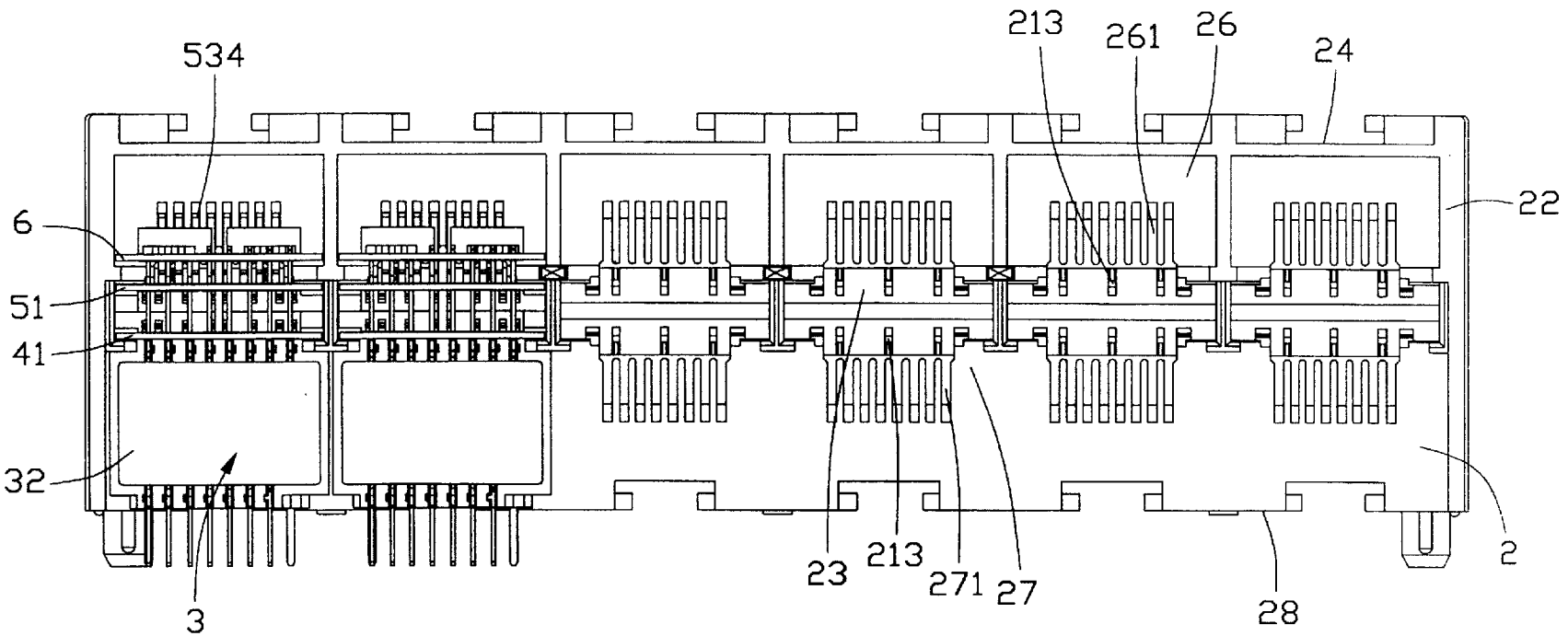
FIG. 4 is a rear view of FIG. 1.
Figure 5:
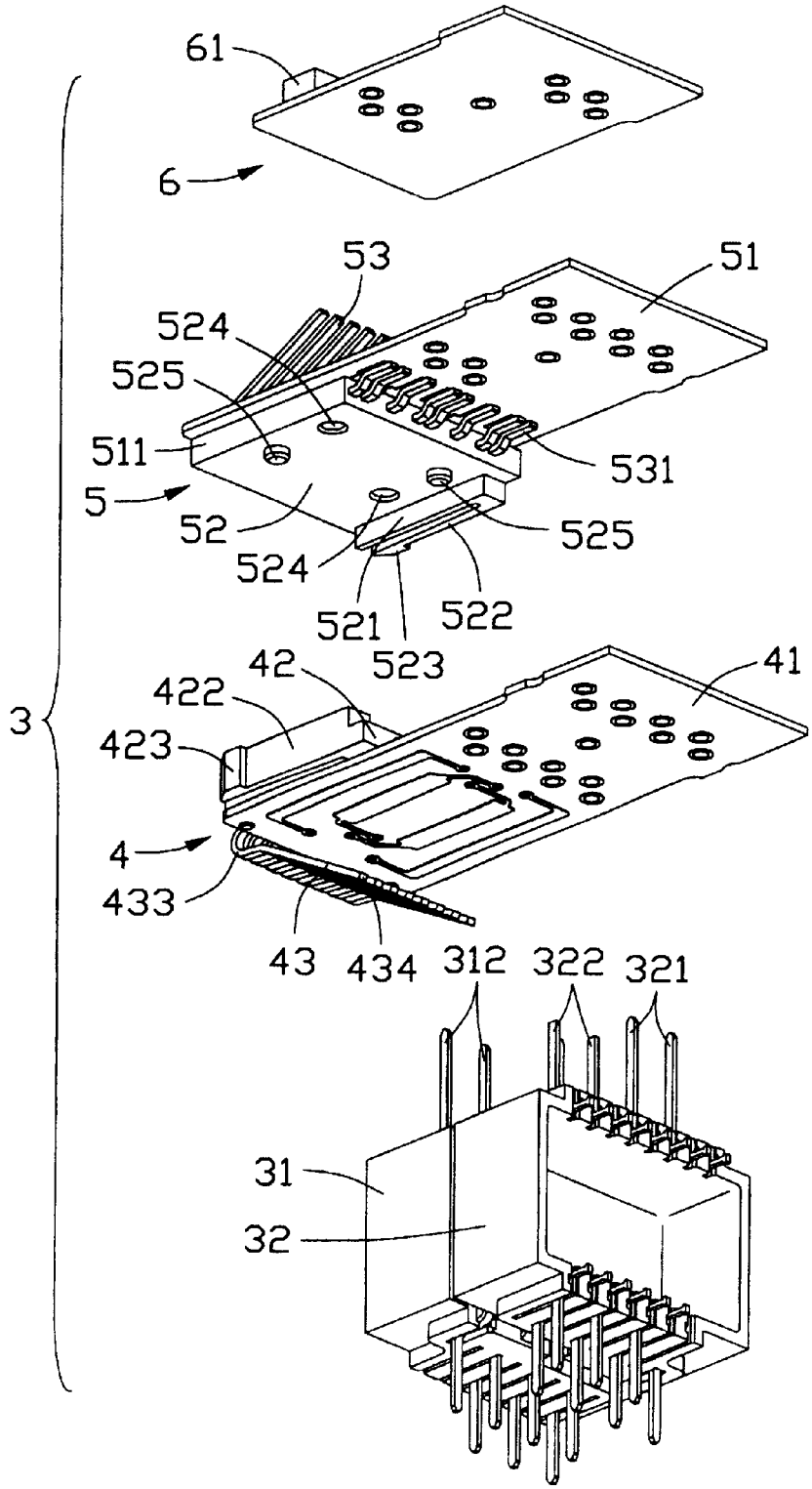
FIG. 5 is an exploded view of an insert subassembly of the modular jack assembly.
Figure 6:
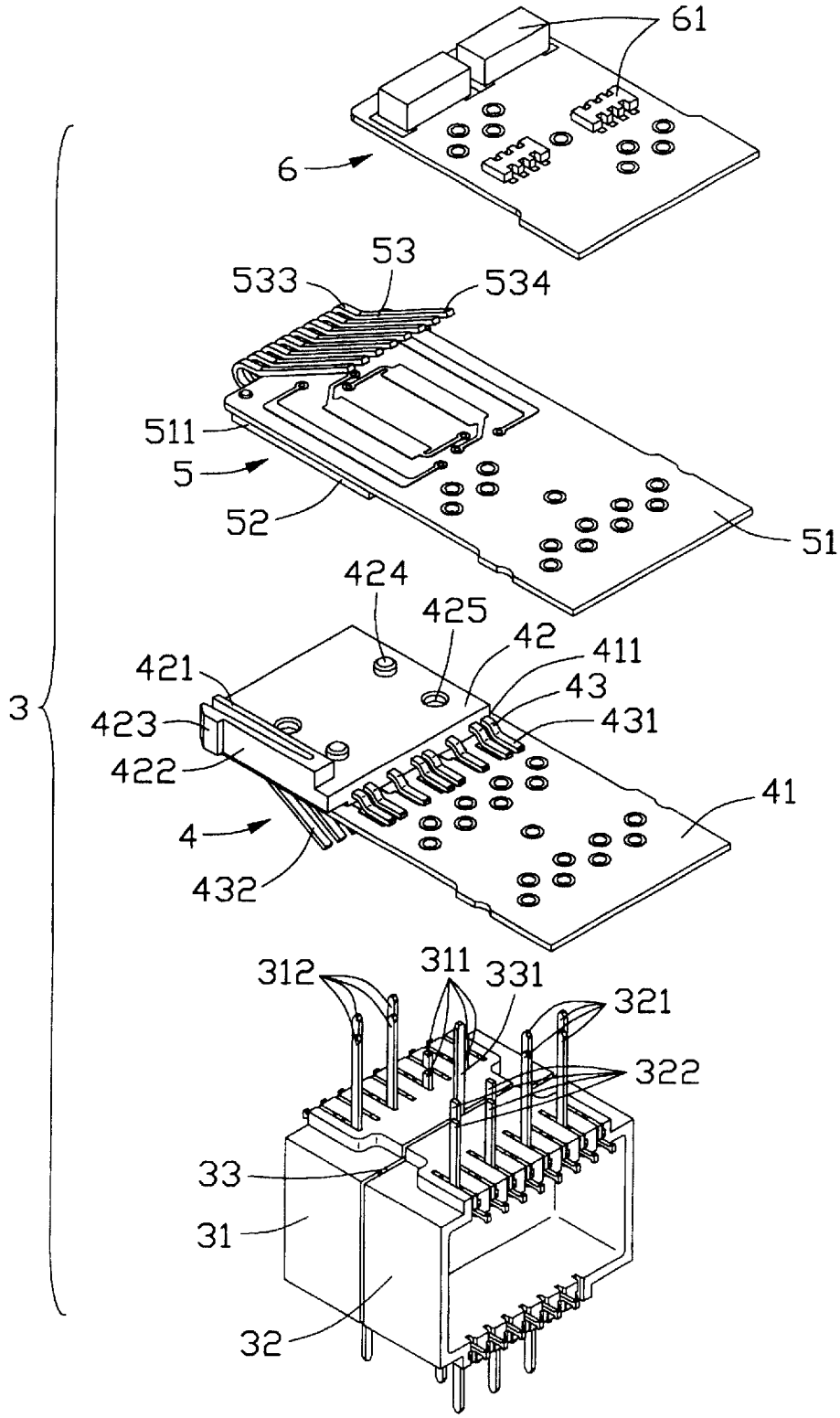
FIG. 6 is another view of FIG. 5.

Referring further to FIGS. 2, 5 and 6, each insert subassembly 3 includes a front receptacle 31, a rear receptacle 32, a ground plate 33 (shown in FIG. 4) sandwiched between the front and the rear receptacle 31, 32, a lower contact module 4 exposed to a corresponding mating opening 212, an upper contact module 5 exposed to a corresponding mating opening 211, and a top printed circuit board (PCB) 6 carrying filter elements 61 for filtering noises.

The front receptacle 31 and the rear receptacle 32 both receive a plurality of magnetic coils (not shown) for transmitting signals and filtering noises. The front receptacle 31 comprises a plurality of first and second contacts 311, 312. The rear receptacle 32 comprises a plurality of first and second contacts 321, 322. The ground plate 33 comprises a ground contact 331.

The lower contact module 4 comprises a first PCB 41, a first block 42 mounted on an upper surface of the first PCB 41, and a plurality of juxtaposed first contacts 43 insert molded with the first block 42. A first receiving groove 411 is defined between a right side of the first block 42 and a margin of the upper surface of the first PCB 41. The first block 42 is substantially cubic and comprises a first frame 421 upwardly projecting from a left side thereof. A first resilient latch arm 422 substantially parallel to the first frame 421 and depends on a side of a rear end of the first frame 421. A first engaging protrusion 423 projects outwardly from a free end of the first latch arm 422. The first block 42 forms a pair of first positioning posts 424 diagonally arranged on an upper surface thereof. A pair of first positioning holes 425 are diagonally defined in the upper surface of the first block 42 and are located symmetrically with the first positioning posts 424.

The first contacts 43 are fabricated from a conductive metal. Each first contact 43 has a solder tail portion 431, a mating portion 432, and a stationary portion (not shown) between the solder tail portion 431 and the mating portion 432. The stationary portions are secured into the first block 42. The solder tail portions 431 slightly downward inclines from a rear portion of the stationary portion and then extends rearwardly and horizontally for soldering to the upper surface of the first PCB 41. Each mating portion 432 comprises a bight section 433 extending from a front portion of the stationary portion and an engaging section 434 extending downwardly and rearwardly under a bottom surface of the first PCB 41.

The upper contact module 5 has a construction similar to that of the lower contact module 4 and comprises a second PCB 51, a second block 52 mounted on a bottom surface of the second PCB 51, a plurality of juxtaposed second contacts 53 insert molded with the second block 52.

A second receiving groove 511 is defined between a left side of the second block 42 and a margin of the lower surface of the first PCB 41 for engaging with first frame 421 of the lower contact module 4. The second block 52 forms a second frame 521 on a left side thereof. A second resilient latch arm 522 depends on the second frame 521. The second latch arm 522 forms an engaging protrusion 523 on a free end thereof. The second block 52 comprises a pair of second positioning holes 524 corresponding to the first positioning posts 424 of the lower contact module 4, and a pair of second positioning posts 525 corresponding to the first positioning hole 425 of the lower contact module 4.

Each second contact 53 has the same construction to the first contact 43 and comprises a solder tail portion 531 soldered to the bottom surface of the second PCB 51, a mating portion 532 and a stationary portion (not shown) secured into the second block 52. The mating portion 532 has a bight section 533 and an engaging section 534 extending upwardly and rearwardly above an upper surface of the second PCB 51, Referring to FIGS. 1–6, in assembly, the front receptacle 31 and the rear receptacle 32 are mounted together and sandwich the ground plate therebetween.

The lower contact module 4 is disposed onto upper surfaces of the front and the rear receptacles 31, 32, the first and the second contacts 311, 312 of the front receptacles 31 extend through the first PCB 41 of the lower contact module 4 and are soldered thereon. The contacts 321 and 322 of the rear receptacle 32 and the ground contact 331 of the ground plate 33 respectively extend through the first PCB 41 without soldering.

The upper contact module 5 is disposed onto the lower contact module 4 with the second positioning holes 524 and the second positioning posts 525 engaging with corresponding first positioning posts 424 and first positioning holes 425 of the lower contact module 4. At a result, the second frame 521 of the upper contact module 5 engages with the first receiving groove 411 of the lower contact module 4. The first frame 421 of the lower contact module 4 simultaneously engages with the second receiving groove 511 of the upper contact module 5. The second contacts 312 of the front receptacle 31 and the ground contact 331 of the ground plate 33 extend through the second PCB 51 of the upper contact module 5 without soldering. The first and the second contacts 3 21 and 322 of the rear receptacles 32 extend through the second PCB 51 of the upper contact module 5 and are soldered are soldered to the second PCB 51.

The top PCB 6 is disposed onto the upper contact module 5, the contacts 312, 321 of the front and the rear receptacles 32 and the ground contact 331 of the ground plate 33 extend though the top PCB 6 and are soldered to the top PCB 6 and electrically connected with filer elements 61 via circuit traces (not shown).

The assembled insert subassemblies 3 are inserted into corresponding chambers 23 from the rear wall 22 of the outer case 2. The first and the second latch arms 422, 522 of each insert subassembly 3 engage with a corresponding pair of engaging channels 231. When each insert subassembly 3 is fully inserted into the outer case 2, the first and the second engaging protrusions 423, 523 engage with a corresponding pair of engaging recesses 232, and the ribs 213 of the outer case 2 hold a front portion of the lower and the upper contact modules 4, 5. At the same time, the retaining slits 261, 271 of the upper and the lower retaining members 26, 27 retain free ends of corresponding engaging sections 434, 534 of the first and the second contacts 43, 53.

When a defective insert subassembly 3 is needed to be uninstalled, pulling rearwardly, the resilient latch arms 422, 522 of the defective insert subassembly 3 are forced to be elastically deformed to each other. As the same time, the engaging protrusions 423, 523 of the resilient latch arms 422, 522 disengage from the engaging recesses 232 of the outer case 2. As a result, the defective insert subassembly 3 is rearwardly pulled out from the outer case 2. The modular jack assembly 1 can be renewed by inserting a new insert subassembly 3 with better performance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack assembly comprising:

an outer case defining a chamber and a pair of engaging channels communicating with the chamber; and an insert subassembly detachably received in the chamber of the outer case, comprising:

a first contact module comprising a first block, a plurality of first contacts retained by the first block and a first latch arm, the first latch arm extending from a side of the first block and substantially parallel to the side of the first block; and a second contact module mounted on the first block of the first contact module and comprising a second block, a plurality of second contacts retained by the second block, and a second latch arm substantially opposite to the first latch arm, and formed on a side of the second block, the first and the second latch arm elastically engaging with corresponding engaging channels;

wherein the first and the second latch arms can elastically disengage from the engaging channels.

2. The modular jack assembly as claimed in claim 1, wherein each latch arm of the insert subassembly forms an engaging protrusion on a free end thereof, and wherein each engaging channel of the outer case comprises an engaging recess engaging with the engaging protrusion of the latch arm of the insert subassembly.

3. The modular jack assembly as claimed in claim 1, wherein the first contact module of the insert subassembly comprises a first printed circuit board (PCB) mounted on the first block, and the second contact module comprises a second PCB mounted on the second block.

4. The modular jack assembly as claimed in claim 3, wherein the outer case forms a plurality of ribs retaining the first and the second PCB of the insert subassembly.

5. The modular jack assembly as claimed in claim 3, wherein the first block of the first contact module forms a first fame projecting from a side thereof, the first latch arm depending on the first frame, and wherein the second contact module defines a receiving groove between the second block and the second PCB engaging with the first frame.

6. The modular jack assembly as claimed in claim 3, wherein the second block of the second contact module forms a second frame projecting from a side thereof, the second latch arm depending on the second frame, and wherein the first block and the first PCB together defines a receiving groove therebetween engaging with the second frame.

7. The modular jack assembly as claimed in claim 1, wherein the first block of the first contact module of the insert subassembly forms a positioning post thereon, and the second block of the insert subassembly defines a positioning hole engaging with the positioning post of the first block of the insert subassembly.

8. The modular jack assembly as claimed in claim 1, wherein the first block of the first contact module of the insert subassembly defines a positioning hole therein, and the second block of the insert subassembly forms a positioning post engaging with the positioning hole of the first block of the insert subassembly.

9. The modular jack assembly as claimed in claim 1, wherein the outer case defines a first mating opening and a second mating opening therethrough, the first and the second mating opening communicating with the chamber of the outer case, the first contact module exposed to the first mating opening and a second contact module exposed to the second mating opening.

10. The modular jack assembly as claimed in claim 1, wherein the insert subassembly comprises a pair of receptacles electrically connecting with the first and the second contact modules, and a ground plate sandwiched between the receptacles.

11. The modular jack assembly as claimed in claim 10, wherein the insert subassembly comprises a third PCB carrying a plurality of filter members, the third PCB electrically connecting with the first and the second contact modules, the receptacles and the ground plate.

12. A modular jack assembly comprising:

an outer case defining an chamber, the chamber comprising a pair of engaging channels communicating therewith; and an insert subassembly detachably received in the chamber of the outer case and comprising a first resilient latch arm and a second resilient latch arm, the first and the second latch arms being partially split from the insert subassembly for elastically engaging with corresponding engaging channels of the chamber of the outer case.

13. The modular jack assembly as claimed in claim 12, wherein each latch arm comprises an engaging protrusion on a free end thereof, and wherein each engaging channel of the chamber of the outer case defines an engaging recess for engaging with a corresponding engaging protrusion of the latch arm of the insert subassembly.

14. The modular jack assembly as claimed in claim 12, wherein the insert subassembly comprises a first contact module having a first block and a second contact module having a second block.

15. The modular jack assembly as claimed in claim 14, wherein the first latch arm is formed on the first block, and the second latch arm is formed on the second block and is substantially opposite to the first latch arm.

16. A modular jack assembly comprising:

an outer case defining upper and lower openings in a front portion and a chamber in a rear portion in communication with said upper and lower openings in a front-to-back direction;

a first contact module including thereof a first deflectable latch and a plurality of first contacts extending into the upper opening; and a second contact module including thereof a second deflectable latch and a plurality of second contacts extending into the lower opening; wherein the first contact module and the second contact module are fastened to each other under a condition that the first latch and the second latch are located at two opposite sides of the case while at a same level essentially located between the first contacts and the second contacts for symmetrically locking the first contact module and the second contact module within the case.

* * * * *